US007661651B2

(12) United States Patent
Kronholm

(10) Patent No.: US 7,661,651 B2
(45) Date of Patent: Feb. 16, 2010

(54) APPARATUS FOR CONTROLLING MEDIUM FLOW

(75) Inventor: Harri Kronholm, Tampere (FI)

(73) Assignee: Vaathto Oy, Hollola (FI)

( * ) Notice: Subject to any disclaimer, the term of this patent is extended or adjusted under 35 U.S.C. 154(b) by 13 days.

(21) Appl. No.: 11/117,604

(22) Filed: Apr. 29, 2005

(65) Prior Publication Data

US 2005/0242313 A1 Nov. 3, 2005

(30) Foreign Application Priority Data

Apr. 30, 2004 (FI) ..... 20040625

(51) Int. Cl.
*F16K 47/00* (2006.01)

(52) U.S. Cl. ..... 251/124; 251/122; 251/333; 251/366; 222/559; 222/547; 222/571

(58) Field of Classification Search ..... 222/108, 222/559, 566, 571, 504, 509, 547, 518, 563, 222/564; 251/120–124, 333, 366; 239/583, 239/584

See application file for complete search history.

(56) References Cited

U.S. PATENT DOCUMENTS

| | | | | |
|---|---|---|---|---|
| 154,796 | A | 9/1874 | Husbands et al. | |
| 2,507,851 | A | 5/1950 | Bryant et al. | |
| 3,464,598 | A * | 9/1969 | Curry, Jr. | 222/597 |
| 3,502,249 | A * | 3/1970 | Wagstaff | 222/603 |
| 4,958,669 | A * | 9/1990 | Ohta | 141/311 A |
| 5,137,187 | A * | 8/1992 | Nichols et al. | 222/504 |
| 5,193,593 | A * | 3/1993 | Denis et al. | 141/10 |
| 5,709,777 | A | 1/1998 | Begemann et al. | |
| 5,816,456 | A * | 10/1998 | Graffin | 222/559 |
| 5,900,121 | A | 5/1999 | Lehleiter et al. | |
| 6,409,055 | B1 * | 6/2002 | Officier | 222/559 |
| 6,409,255 | B2 * | 6/2002 | Tilsner et al. | 296/187.09 |
| 6,691,902 | B2 * | 2/2004 | Gomez | 222/566 |
| 6,698,629 | B2 * | 3/2004 | Taylor-McCune | 222/571 |
| 6,860,414 | B2 * | 3/2005 | Solignac | 222/504 |

FOREIGN PATENT DOCUMENTS

| | | | |
|---|---|---|---|
| DE | 391407 C | | 3/1924 |
| EP | 0674042 A1 | | 9/1995 |
| WO | WO 02/070395 | * | 9/2002 |

* cited by examiner

*Primary Examiner*—J. Casimer Jacyna
(74) *Attorney, Agent, or Firm*—Birch, Stewart, Kolasch & Birch, LLP

(57) ABSTRACT

An apparatus for controlling medium flow, especially for controlling dilution liquid flow in connection with the headbox of a paper-making machine or a cardboard-manufacturing machine, which apparatus comprises a valve which controls dilution flow, which valve consists of a valve housing, a stem part and a flow channel between an inlet and an outlet of the valve. The stem part is movable in the housing between at least two positions, a first position in which the flow path between the inlet and the outlet is open, and a second position in which the flow path is closed, and the stem part and/or housing is designed to direct the medium flow at least in the vicinity of the outlet opening.

17 Claims, 6 Drawing Sheets

APPARATUS FOR CONTROLLING MEDIUM FLOW

BACKGROUND OF THE INVENTION

1. Field of the Invention

The invention relates to an apparatus for controlling medium flow, especially for controlling dilution liquid flow in connection with the headbox of a paper-making machine or a cardboard-manufacturing machine, which apparatus comprises a valve which controls dilution flow, which valve consists of a valve housing, a stem part and a flow channel between an inlet and an outlet of the valve.

2. Description of Background Art

Dilution valves are utilised for controlling the flow of dilution liquid to stock flow. Dilution flow may be clean or fibre-bearing water. Dilution water may be, for example, tail water taken from the web as retention. Solutions are known in which, a rotatable valve stem is used in the dilution valve which stem may be rotatable to different control positions for controlling the dilution flow starting from the valve. Such solution is presented in, inter alia, specification FI110879B. However, different problems occur in these solutions. Because there is fines included in the tail water, there is a strong possibility of the valve stem getting blocked in the rotatable valve, especially when dilution water reaches between the stem and the valve body. Such solutions require an extremely strong actuator to rotate the stem. In addition, frequent so-called wash moving of the stem is typically required in order to prevent the blocking of the stem. In addition, the solution requires utilising extremely precise tolerances, whereby the solution becomes manufacturing-technically demanding and expensive to manufacture. Typically, the solution requisites utilising an actuator adapted for the use in question, which frequently increases costs. Furthermore, the flow range of the dilution valves in question is fixed. Equivalent problems occur also in a solution presented in specification FI100895B, in which the flow path is formed to the stem which is moved to and fro, and in which the choke is controlled on the side of the valve inlet.

The object of this invention is to achieve a totally novel solution for a dilution valve, whereby the disadvantages of known prior-art are avoided.

BRIEF DESCRIPTION OF THE INVENTION

It is characteristic for the apparatus according to the invention that the stem part is movable in the housing between at least two positions, a first position in which the flow path between the inlet and the outlet is open, and a second position in which the flow path is closed, and that the stem part and/or housing is designed to direct the medium flow at least in the vicinity of the outlet opening.

The solution according to the invention has numerous significant advantages. The dilution valve according to the invention does not get blocked. No great forces are required for moving the valve stem. Common actuators available from several different manufacturers may be easily adapted for the valve actuator. With this solution, contamination and valve leaks are easily avoided. This solution does not require precise tolerances. The flow range may be altered by utilising a replaceable mixing sleeve. The pressure loss accomplished with the design of a mixing zone prevents a so-called flow phenomenon. With the design of the mixing zone parts, it is possible to decrease the forming of flocks and, on the other hand, to break the flocks formed. By replacing the mixing sleeve, it is possible to enlarge or reduce the flow range. By using a to-and-fro linear movement for moving the stem, easy compactability and light, small-force-requiring moving are again achieved. From this results also ease of manufacturing because the structure does not require precise tolerances.

BRIEF DESCRIPTION OF THE FIGURES

In the following, the invention will be described in detail by means of an example with reference to the accompanying drawing, wherein.

DETAILED DESCRIPTION OF THE INVENTION

Figure 1:
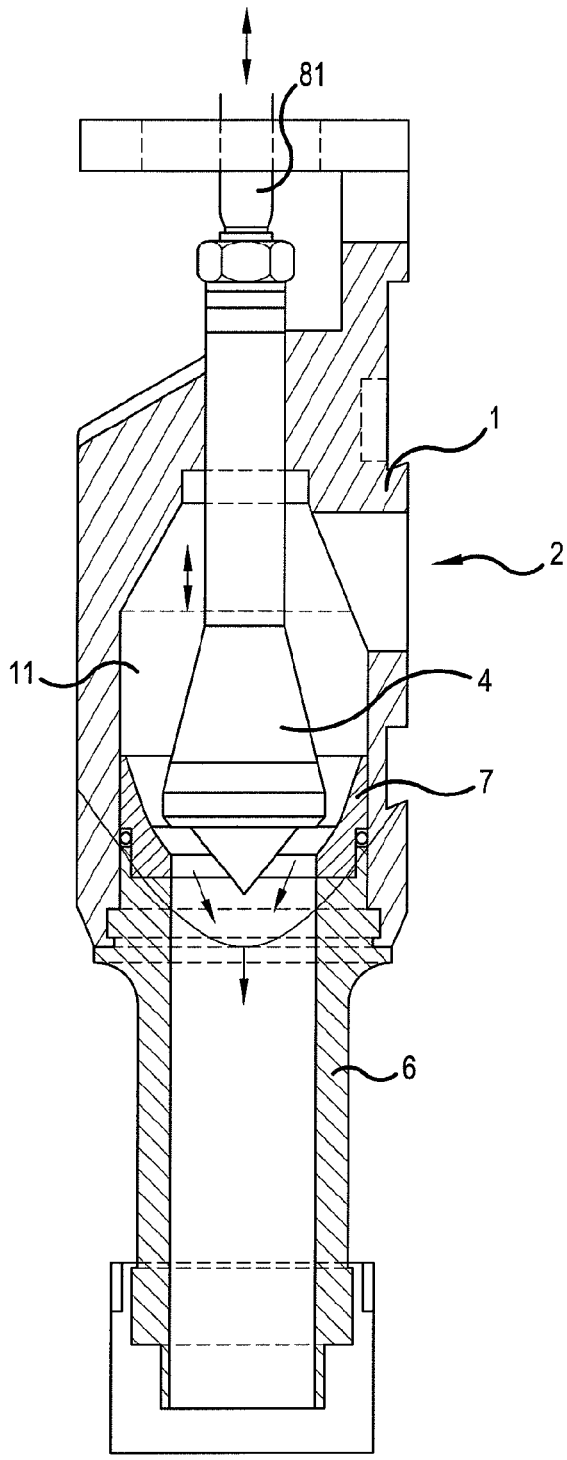
FIG. 1 presents an apparatus according to the invention as a cross section with the stem in a first position.
Figure 2:
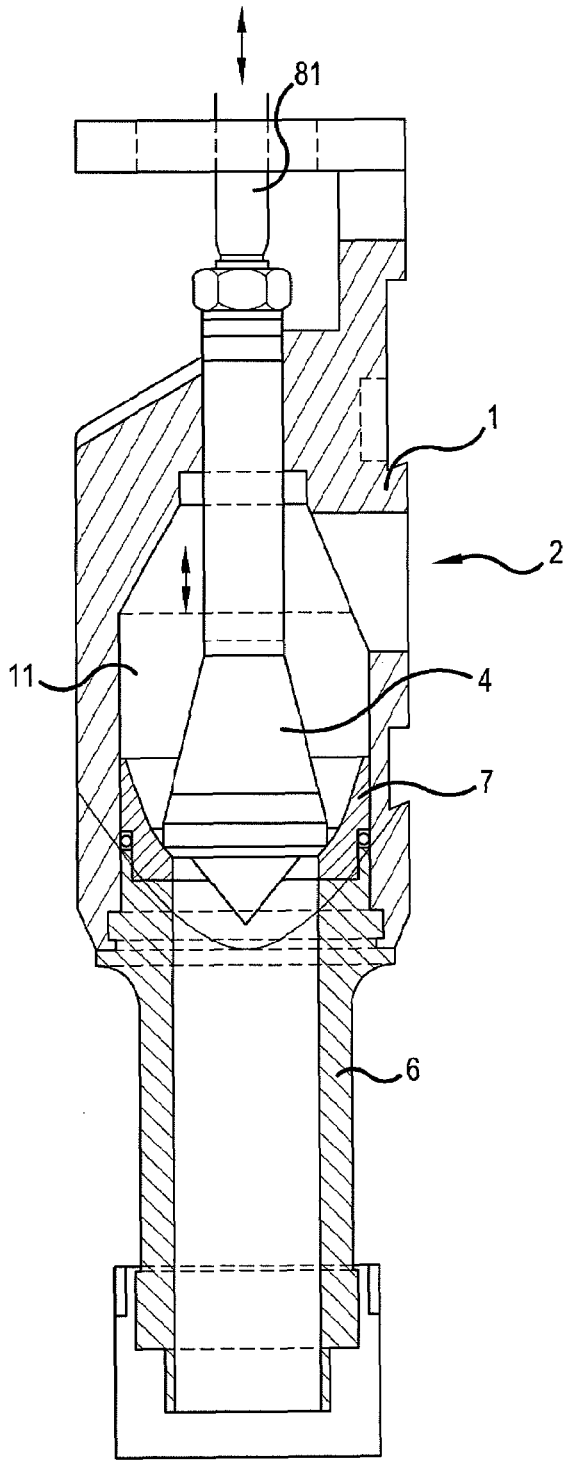
FIG. 2 presents an apparatus according to the invention as a cross section with the stem in a second position.
Figure 3:
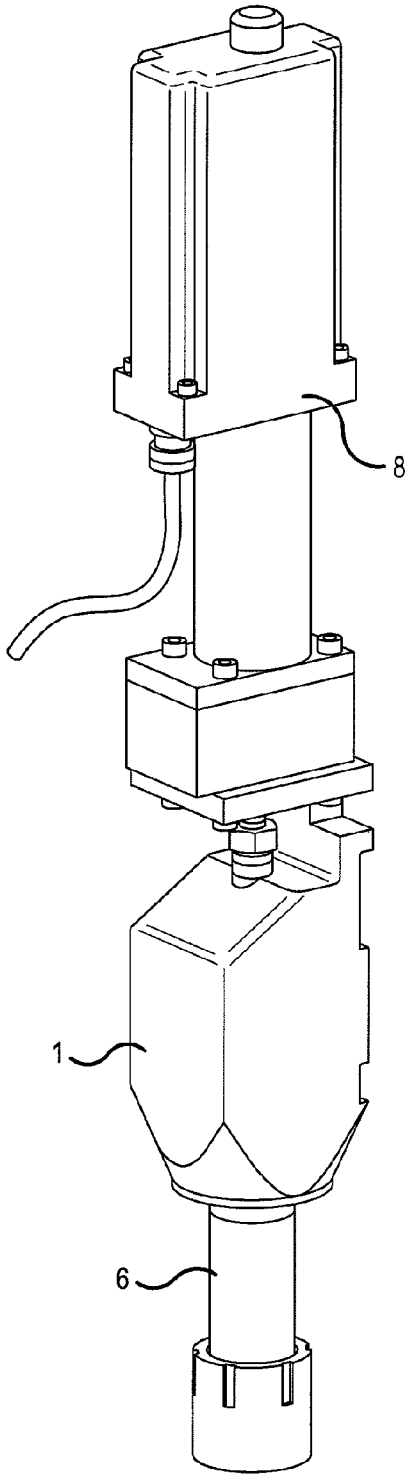
FIG. 3 presents an apparatus according to the invention together with an actuator.

FIGS. 1 and 2 present an apparatus according to the invention in cross-section. The apparatus comprises a dilution valve housing, that is, body part 1 which has an inlet 2. The housing, that is, the body part comprises a chamber area 11, into which there is a flow path from the inlet 2. On the other hand, from the chamber area 11 is arranged an outlet 3. To the housing is arranged movably a stem part 4 which is movable between at least two positions, a first position in which the flow path to the outlet 3 is open, and a second position in which the flow path to the outlet 3 is closed. Typically, between the first and the second position there may be several intermediate positions, whereby the choke of the flow path may be controlled. The stem part is moved with an actuator 8 (FIG. 3). Depending on the type of the actuator 8, the control may be stepless or stepped. The actuator may be any one actuator intended for linear to-and-fro control, such as a pressure-medium-operated piston-cylinder combination or a mechanical motion screw which is operated with an actuator, such as an electric motor.

Figure 4:
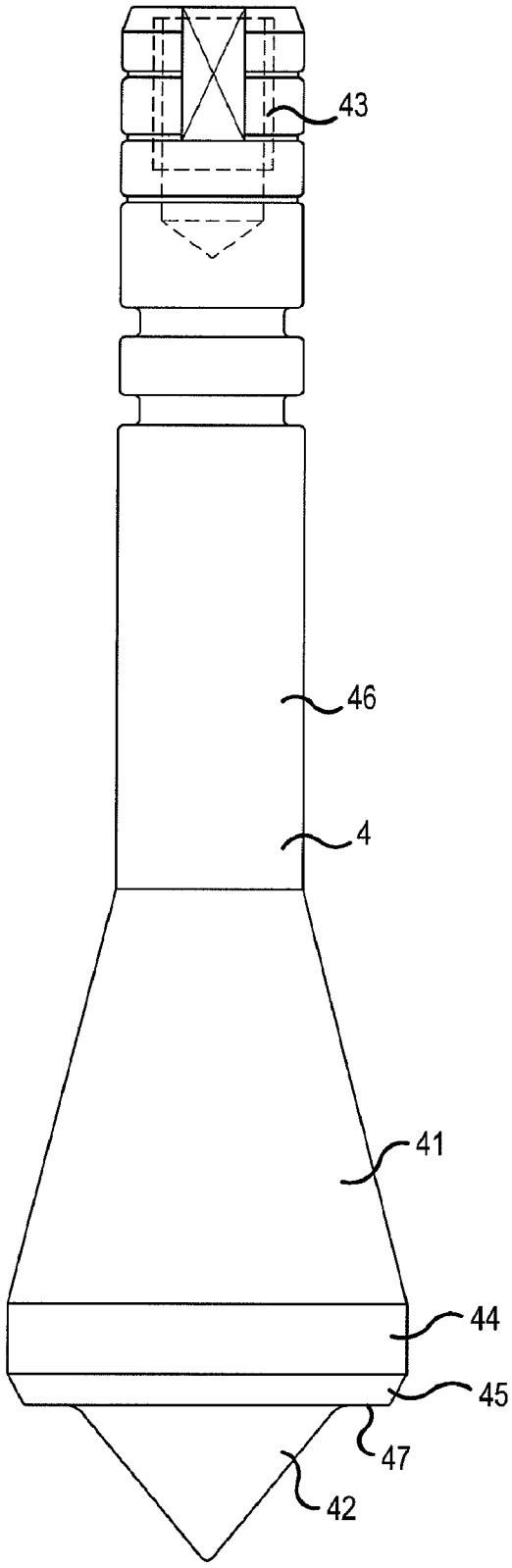
FIG. 4 presents a stem part of the apparatus according to the invention in more detail in a different scale.

A stem part 4 according to an embodiment of the invention is presented in detail in FIG. 4. In the figure, the stem part 4 comprises a first end 42 which is towards the outlet (in FIG. 1), and a second end 43 from which the stem part is fastened to the actuator, for example, through a fastening means. The stem part comprises an abutment surface 45 for a valve sealing surface 72. The stem part has an extending cone surface 41 which extends towards the first end. Between the extending cone surface 41 and the first end is first a cylinder surface 44, and following that, a tapering cone surface 45 and a transversal surface 47 in respect of the longitudinal axis of the stem. Following this, the stem part has a cone-like tip part 42. The extending cone part 41 is typically in the area between the inlet and the outlet of the valve. The cone-like tip part 42 is typically after the outlet opening 3.

Figure 5A:
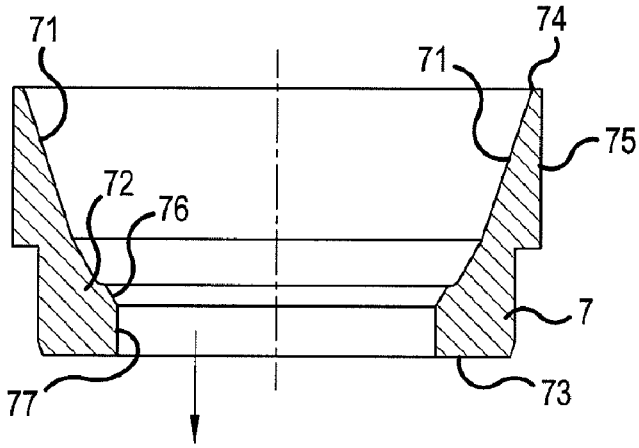
FIG. 5A presents a sleeve member of the apparatus according to the invention in more detail in a different scale.
Figure 6:
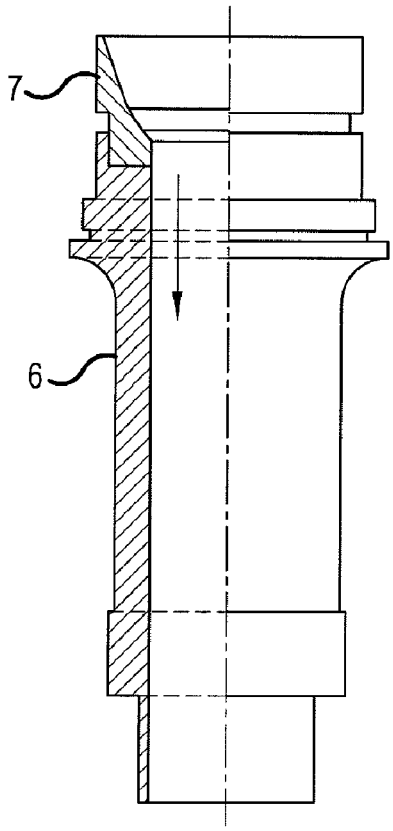
FIG. 6 presents sleeve member of FIGS. 5A and 5B together with an outlet pipe according to the invention in a different scale.
Figure 5B:
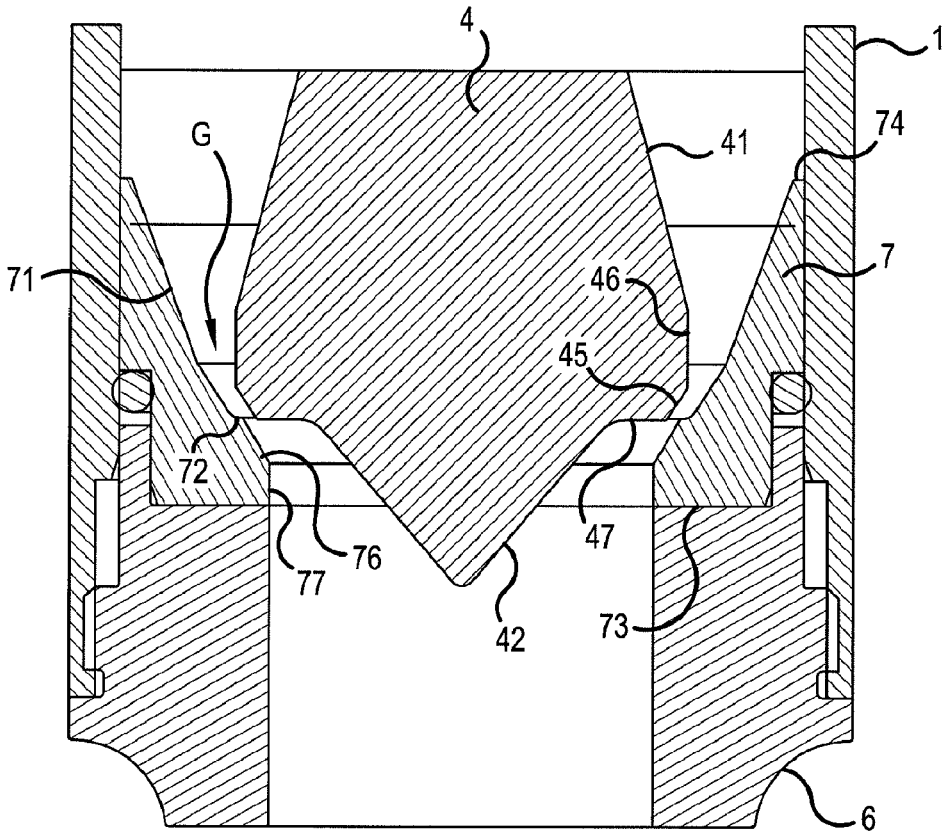
FIG. 5B is a cross-sectional exploded view of illustrating portions of the housing, the sleeve member, the stem part, and an outlet pipe of the apparatus.

To the chamber area 11, typically in the vicinity of the outlet 3, may be arranged a sleeve member 7. The sleeve member 7 is adapted to function together with the stem part 4, typically as its counterpart. The sleeve member 7 comprises a counter surface 71, 72 for the surface of the stem part. The sleeve member 7 is a so-called mixing ring with which the flow may be deflected towards the stem part 4, especially towards the tip part 42 of the stem part 4. The sleeve member 7 is advantageously a replaceable part, whereby the characteristics of the valve member, such as flow characteristics, may be adapted depending use. As shown FIGS. 5A and 5B, sleeve member 7 has an inner surface including: an upper truncated conical portion 71 that tapers inwardly and downwardly from a top end 74 of the sleeve member 7 in a direction toward a lower end 73 of the sleeve member 7, a transverse lip portion 72 extending inwardly in a radial direction from a lower end of the upper truncated conical portion 71, a lower truncated conical portion 76 that tapers inwardly and downwardly from a inner circumferential edge of the transverse lip portion 72, and a cylindrical part 77 extending downward from a lower edge of the lower truncated conical portion 76. When the stem part 4 is in an open position, a small gap G exists between the abutment surface 45 of the stem part 4 and upper truncated conical portion 71 of the sleeve member. When the stem part 4 is in the open position, the transverse lip portion 72 of the sleeve member 7 deflects the fibre containing medium flow toward the stem part 4. When the stem part 4 is in a closed position, the abutment surface 45 (the lower truncated conical part) on the outer surface of the stem part 4 is fitted against the lower truncated conical part 76 of the sleeve member 7. The outer cylindrical surface 75 of sleeve-member 7 fits against an inner cylindrical surface of the housing 1. (See FIGS. 1, 2, 5A and 5B) The sleeve 7 may be arranged to be fastened to the valve body, together with an outlet pipe 6. Specifically, the lower end 73 of the sleeve member 7 fits against an upper part of the outlet pipe 6. FIG. 6 presents a combination of the sleeve member 7 and the outlet pipe 6. The inner surface of the sleeve member 7 deflects the medium flow towards the stem 4, whereby the medium flow impacts most advantageously the tip part 42 of the stem 4 which breaks the possible flocks in the flow medium.

Thus, the invention relates to an apparatus for controlling medium flow, especially for controlling dilution liquid flow in connection with the headbox of a paper-making machine or a cardboard-manufacturing machine, which apparatus comprises a valve which controls dilution flow, which valve consists of a valve housing 1, a stem part 4 and a flow channel between an inlet 2 and an outlet 3 of the valve. The stem part 4 is movable in the housing between at least two positions, a first position in which the flow path between the inlet and the outlet is open, and a second position in which the flow path is closed, and the stem part 4 and/or housing is designed to direct the medium flow at least in the vicinity of the outlet opening.

The stem part 4 and/or the housing 1 is designed or arranged to mix the medium flow. To the apparatus is arranged a sleeve member 7 which constitutes at least a part of an abutment surface to the stem part 4. The sleeve member 7 is arranged to the housing to the outlet opening 3 or its vicinity. The sleeve member 7 comprises a surface 71, 72 which deflects the medium flow.

The stem part 4 comprises in the first end, on the side of the outlet, a tip part 42. According to an embodiment of the invention, the stem part 4 comprises also advantageously an extending part 41, which is most advantageously arranged in the stem part to the portion between the valve inlet 2 and the stem tip part 42.

The sleeve member 7 is replaceable, whereby its design may be adapted according to the target of application. The sleeve member 7 is arranged to be fastened to the housing 1 together with the outlet pipe 6.

It is obvious to those skilled in the art that the invention is not limited to the embodiments described above, but it may be varied within the scope of the enclosed claims. If required, the characteristic features possibly described in this specification together with other characteristic features may also be used separate from each other.

The invention claimed is:

1. A dilution liquid flow controlling apparatus used in connection with the headbox of a paper-making machine or a cardboard-manufacturing machine comprising:

a valve which controls dilution flow, the valve including:

a valve housing, a stem part, a flow channel between an inlet and an outlet of the valve, and a sleeve member fitted inside the housing, the sleeve member serving as a mixing sleeve and having an inner surface, wherein the sleeve member includes a transverse top end, and wherein the inner surface of the sleeve member includes:

an upper truncated conical portion that extends directly from the top end of the sleeve member and tapers inwardly and downwardly from the transverse top end in a direction toward a lower end of the sleeve member, a transverse lip portion extending inwardly in a radial direction from a lower end of the upper truncated conical portion, the transverse lip portion being adapted to deflect the fibre containing medium flow toward the stem part, wherein the stem part includes:

a single conical-shaped tip part, a diameter of which decreases in a direction of the outlet, a ring-shaped transverse surface extending radially outwardly at an upper end of the single conical-shaped tip part, and a single truncated conical part extending upwardly from an outer circumferential edge of the ring-shaped transverse surface, wherein the stem part is movable in the sleeve member between at least two positions, a first position in which a flow path between the inlet and the outlet is open, and a second position in which the single truncated conical part of the stem part is fitted against a part of the inner surface of the sleeve member that is immediately below the transverse lip portion, in which case the flow path is closed and wherein the single conical-shaped tip part has an upper end adjoining the ring-shaped transverse surface and a lower end which is a lower-most part of the stem part.

2. The apparatus according to claim 1, wherein the stem part and/or the sleeve member and housing is designed to mix the fibre containing medium flow.

3. The apparatus according to claim 1, wherein the part of the inner surface that is immediately below the transverse lip portion of the sleeve member comprises at least a part of an abutment surface for the stem part.

4. The apparatus according to claim 1, wherein the sleeve member is arranged in the housing adjacent to the outlet.

5. The apparatus according to claim 1, wherein the part of the inner surface immediately below the transverse lip portion of the sleeve member comprises a lower truncated conical portion that tapers inwardly and downwardly from an inner circumferential edge of the transverse lip portion, and when the stem part is in a closed position, the single truncated conical part of the stem part is fitted against the lower truncated conical portion of the sleeve member, and only a lower portion of the single conical-shaped tip part extends below a lower end of the sleeve member.

6. The apparatus according to claim 1, wherein the outer surface of the stem part comprises:

an upper cylindrical part, an extending cone surface extending outwardly and downwardly from a lower end of the upper cylindrical part, a lower cylindrical part extending downwardly from a lower end of the extending cone surface, wherein the single truncated conical part extends inwardly and downwardly from a lower end of the lower cylindrical part, and wherein the ring-shaped transverse surface extends radially inwardly from a lower circumferential edge of the single truncated conical part.

7. The apparatus according to claim 1, wherein the sleeve member is a replaceable sleeve member having a design that is adapted according to a target of application.

8. The apparatus according to claim 1, wherein the sleeve member is arranged to be fastened to the housing together with an outlet pipe.

9. A dilution liquid flow controlling apparatus used in connection with the headbox of a paper-making machine or a cardboard-manufacturing machine comprising:

a valve which controls dilution flow, the valve having a valve housing and an outlet pipe, a stem part and a flow channel between an inlet and an outlet of the valve, and a sleeve member serving as a mixing sleeve and having an upper end fitted inside a lower open end of the housing, and a lower end fitted inside an upper open end of the outlet pipe, wherein the stem part and the sleeve member form a mixing zone, which direct and mix the fibre containing medium flow in a vicinity of the outlet, wherein the sleeve member includes a transverse top end, and wherein an inner surface of the sleeve member includes:

an upper conical portion with a diameter that reduces starting from the transverse top end of the sleeve member and extends in a direction towards a lower end of sleeve member, a transverse lip portion which deflects the fibre containing medium flow towards the stem part, and an abutting surface immediately below the transverse lip portion, wherein the stem part comprises:

an upper cylindrical part, an extending part extending outwardly and downwardly from a lower end of the upper cylindrical part, a lower cylindrical part extending downwardly from a lower end of the extending part, and a single truncated conical part extending inwardly and downwardly from a lower end of the lower cylindrical part, each of which is arranged in the stem part between the valve inlet and a single conical-shaped tip part of the stem part which is adjacent to the outlet, wherein the stem part is movable in the housing between at least two positions, a first position in which a flow path between the inlet and the outlet is open, and a second position in which the flow path is closed, and when the stem part is in a closed position the single truncated conical part of the stem part is fitted against the abutting surface of the sleeve member that is immediately below the transverse lip portion, when the stem part is in the closed position an entirety of the single conical-shaped tip part extends below the abutting surface immediately below the transverse lip portion of the sleeve member, and directly faces an inner cylindrical surface at the lower end of the sleeve member and an adjoining portion of an inner cylindrical surface of an outlet pipe immediately below the inner cylindrical surface of the sleeve member, wherein the stem part and/or housing is designed to direct the fibre containing medium flow at least in a vicinity of the outlet.

10. The apparatus according to claim 9, wherein the stem part and/or the sleeve member and housing is designed to mix the fibre containing medium flow.

11. The apparatus according to claim 9, wherein the abutting surface immediately below the transverse lip portion of the sleeve member comprises at least a part of an abutment surface for the stem part.

12. The apparatus according to claim 9, wherein the sleeve member is arranged in the housing adjacent to the outlet.

13. The apparatus according to claim 9, wherein the abutting surface immediately below the transverse lip portion of the sleeve member comprises a lower truncated conical portion that tapers inwardly and downwardly from an inner circumferential edge of the transverse lip portion, and when the stem part is in a closed position, the single truncated conical part of the stem part is fitted against the lower truncated conical portion of the sleeve member.

14. The apparatus according to claim 9, wherein when the stem part is in the closed position only a lower portion of the single conical-shaped tip part extends below the inner cylindrical surface at the lower end of the sleeve member.

15. The apparatus according to claim 9, wherein the sleeve member is a replaceable sleeve member having a design that is adapted according to a target of application.

16. A dilution liquid flow controlling apparatus in connection with the headbox of a paper-making machine or a cardboard-manufacturing machine comprising:

a valve which controls dilution flow, the valve including:

a valve housing, a stem part having a single truncated conical part, and a single conical-shaped tip part disposed below the single truncated conical part, a flow channel between an inlet and an outlet of the valve, and a sleeve member fitted inside the housing, the sleeve member serving as a mixing sleeve and having an inner surface, wherein the sleeve member includes a transverse top end, wherein the inner surface of the sleeve member includes:

an upper truncated conical portion that extends directly from the top end of the sleeve member and tapers inwardly and downwardly from the transverse top end in a direction toward a lower end of the sleeve member, a transverse lip portion extending inwardly in a radial direction from a lower end of the upper truncated conical portion, the transverse lip portion being adapted to deflect the fibre containing medium flow toward the stem part, wherein the stem part is movable in the sleeve member between at least two positions, a first position in which a flow path between the inlet and the outlet is open, and a second position in which a single truncated conical part of the stem part is fitted against a part of the inner surface of the sleeve member that is immediately below the transverse lip portion, in which case the flow path is closed, wherein the part of the inner surface that is immediately below the transverse lip portion of the sleeve member comprises a lower truncated conical portion that tapers inwardly and downwardly from an inner circumferential edge of the transverse lip portion, and when the stem part is in a closed position, the single truncated conical part of the stem part is fitted against the lower truncated conical part of the sleeve member, and wherein the single conical-shaped tip part extends downwardly in an axial direction from a position coinciding with a lower-most part of the single truncated conical part to a lower-most part of the stem part.

17. The apparatus according to claim 16, wherein the tip part is formed on a side of the stem part adjacent to the outlet.

* * * * *